US005358551A

United States Patent [19]

Saylor

[11] Patent Number: 5,358,551

[45] Date of Patent: Oct. 25, 1994

[54] TURBULENCE INHIBITING TUNDISH AND IMPACT PAD AND METHOD OF USING

[75] Inventor: Karl J. Saylor, Maineville, Ohio

[73] Assignee: CCPI, Inc., Blanchester, Ohio

[21] Appl. No.: 153,662

[22] Filed: Nov. 16, 1993

[51] Int. Cl.[5] ..... C21B 7/14

[52] U.S. Cl. ..... 75/584; 164/437; 222/594; 266/275

[58] Field of Search ..... 266/275, 227, 287; 164/437; 222/594; 75/584

[56] References Cited

U.S. PATENT DOCUMENTS

| | | | |
|---|---|---|---|
| 3,887,171 | 6/1975 | Neuhaus | 164/437 |
| 4,671,499 | 6/1987 | Ishiyama et al. . | |
| 4,715,586 | 12/1987 | Schmidt et al. . | |
| 4,776,570 | 10/1988 | Vo Thanh et al. . | |
| 5,131,635 | 7/1992 | Soofi . | |
| 5,133,535 | 7/1992 | Soofi . | |
| 5,139,239 | 8/1992 | Eccleston . | |
| 5,160,480 | 11/1992 | Vassilicos . | |
| 5,169,591 | 12/1992 | Schmidt et al. | 266/227 |
| 5,188,796 | 2/1993 | Soofi . | |

FOREIGN PATENT DOCUMENTS 2643009 3/1978 Fed. Rep. of Germany .

OTHER PUBLICATIONS

Harris, D. J., Young, J. D., "Water Modeling–A Viable Production Tool", Research and Development Dept., Stelco, Inc., pp. 99–112.

*Primary Examiner*—Melvyn J. Andrews
*Attorney, Agent, or Firm*—Wood, Herron & Evans

[57] ABSTRACT

A tundish and, more specifically, an impact pad is formed with a bottom impact surface and includes an outer side wall extending upwardly therefrom which fully encloses an interior space or cavity having an upper opening into which molten metal is directed from a ladle shroud. The outer side wall of the pad includes an inner surface extending from the bottom impact surface to the opening of the pad. The inner side wall surface includes an annular portion which extends inwardly and upwardly toward the opening of the pad. In the preferred embodiment, the inner side wall surface curves continuously from the bottom impact surface to a vertical wall defining the opening of the pad. The pad redirects the pouring stream back into itself causing the counter current flows to slow each other down thereby minimizing turbulence and inhibiting high velocity flow within the tundish. The upward flow is further is advantageously directed away from the incoming pouring stream toward the surface of the bath.

21 Claims, 2 Drawing Sheets

TURBULENCE INHIBITING TUNDISH AND IMPACT PAD AND METHOD OF USING

BACKGROUND OF THE INVENTION

The present invention generally relates to tundish vessels and, more particularly, to tundish impact pads designed to inhibit turbulent flow of molten metal within the tundish.

Tundishes are used to hold a quantity or bath of molten metal, such as molten iron or steel, delivered from a ladle through a ladle shroud. A tundish is disposed between the ladle and the casting apparatus or mold which receives the molten metal and forms various shaped products therefrom. The ladle is positioned several feet above the tundish and a ladle shroud, in the form of a long tube, leads from the ladle into the tundish. The ladle shroud delivers the molten metal to the tundish in a tight, compact stream. This incoming stream of molten metal can, for example, have kinetic energy ranging from 2 to 10 Watts/ton.

Pouring pads placed within tundishes have been widely used to prevent damage to the working and safety linings of a tundish by the force of the incoming stream of molten metal. The kinetic energy of the incoming stream of molten metal also creates turbulence which can spread throughout the tundish if the flow of molten metal is not properly controlled. Many times, this turbulence has a detrimental effect on the quality of cast products formed from metal taken from the tundish. More specifically, turbulent flow and high velocity flow within the tundish can, for example, have the following harmful effects:

1. Excessive turbulence can disturb the steel surface and promote emulsification of the slag at ladle changes or during operation of the tundish with a relatively low level of molten metal.

2. High velocities produced by turbulent flow in the pouring area can cause erosion of the working lining of the tundish which is typically comprised of a refractory material having a much lower density than impact pads.

3. Highly turbulent flow within the tundish can impede the separation of inclusions, especially inclusions less than 50 microns in size, due to the fluctuating nature of such turbulent flows.

4. High speed flows may also increase the possibility of slag being directed into a mold through increased vortexing of the molten metal in the tundish which draws slag downwardly toward the outlet.

5. Turbulent flow within the tundish may result in disturbance of the slag/metal interface near the top of the metal bath and thereby promote slag entrainment as well as the possibility of opening up an "eye" or space within the slag layer which can be a source of reoxidation of the molten metal.

6. High levels of turbulence in the tundish can be carried down into the pouring stream between the tundish and the mold. This can cause "bugging" and "flaring" of the pouring stream which thereby lead to casting difficulties.

7. High velocity flow in the tundish has also been attributed to a condition known as "short circuiting". Short circuiting refers to the short path a stream of molten metal may take from the ladle to the impact pad to the nearest outlet in the tundish. This is undesirable since it reduces the amount of time inclusions have to be dissipated within the bath. Instead, the high velocity flow sweeps relatively large inclusions down into the mold where they reduce the quality of the cast products.

A typical flat impact pad causes an incoming ladle stream to impact the top of the pad and travel quickly to the side or end walls of the tundish. When the stream reaches the side and/or end walls, it rebounds upward to the surface of the tundish where it changes direction toward the center of the tundish or, in other words, toward the incoming ladle stream. This creates undesirable inwardly directed circular flows in the tundish. The opposing flows on either side or end of the tundish travel toward the center of the tundish and carry with them slag or other impurities that have floated to the surface of the bath within the tundish. As a result, these impurities are drawn toward the incoming ladle stream and are then forced downwardly into the bath and toward the outlet or outlets of the tundish. This tends to cause more of these impurities to exit the tundish into the molds thereby decreasing the quality of the products produced within the molds.

While numerous other types of tundish pads have been proposed and used in the past, none of these fully address all of the problems noted above. Examples of prior tundish pads are disclosed in U.S. Pat. Nos. 5,131,635 and 5,133,535 both issued to Soofi and U.S. Pat. No. 5,169,591 to Schmidt et al. The tundish pads disclosed in the above patents to Soofi and Schmidt et al., however, are inadequate solutions to the above-mentioned problems at least because of the fact that they each direct the incoming ladle stream too directly toward the drain or drains of the tundish. Also, these pads do not slow the incoming ladle stream enough to completely address the problems associated with high velocity flows as mentioned above. In this regard, since each of these patents disclose impact pads which direct the incoming stream in either one or two lateral directions toward the drain or drains of the tundish, the speed of the ladle stream is not reduced enough to prevent many of the problems mentioned above. Moreover, directing the ladle stream toward the drain or drains of the tundish, as taught by these patents, leads to the previously explained problems of "bugging", "flaring" and "short circuiting".

SUMMARY OF THE INVENTION

The present invention provides a turbulence inhibiting tundish impact pad formed with a bottom impact surface and including an endless annular side wall extending upwardly therefrom and fully enclosing an interior space or cavity having an upper opening into which the molten metal is directed from a ladle shroud. The endless annular side wall of the pad includes an annular inner surface having at least a portion extending upwardly with respect to the bottom impact surface and inwardly toward the opening of the pad. The endless annular side wall fully encloses the interior space of the pad such that the incoming stream of metal is redirected back into itself and a flow pattern is created which directs the reversed flow of metal away from the ladle shroud.

In the first embodiment the pad is circularly shaped as viewed from the top as is the inner surface of the annular side wall. The inner surface of the side wall is concavely curved first outwardly and upwardly from the bottom impact surface and then inwardly and upwardly to a vertically disposed surface which defines the opening of the pad. The inner side wall surface preferably curves continuously from the bottom impact surface to the vertical wall defining the opening of the pad.

In a second embodiment of this invention the impact pad is formed with a rectangular shape while still retaining the feature of having a fully enclosed interior space defined by an endless annular side wall. In this regard, the term "annular" as used throughout the specification and claims is not meant to denote any particular shape but is meant to indicate a fully enclosing, endless boundary structure. In the second embodiment the inner side wall surface includes at least a portion which extends upwardly and inwardly toward a central opening in the top of the impact pad. The same desirable flow pattern is created within a tundish using a pad constructed according to either the first or second embodiments of the invention.

The tundish pouring pads of the present invention not only withstand the impact of the incoming ladle strain but also dampens the associated turbulence usually created by the stream. To this end, and in solving the previously mentioned problems in the prior art, a pad constructed in accordance with the present invention redirects the pouring stream back into itself causing the counter current flows to slow each other down thereby minimizing turbulence and inhibiting high velocity flow within the tundish. The fully enclosed cavity of the pad changes the path of the incoming stream from vertically downwards to vertically upwards. The flow pattern created by the pad forms a path of molten metal which travels slowly upwards toward the surface of the metal bath and then radially outwardly in all directions toward the walls of the tundish. This is not only a favorable flow condition for flotation of impurities but also contributes to temperature homogeneity in the tundish. Most importantly, it minimizes the harmful effects of excessive turbulence and high flow velocities within the tundish.

The turbulence inhibiting pads of the present invention provide a much more advantageous flow pattern than the prior pads mentioned above which direct the incoming ladle stream to one or more sides or ends of the tundish immediately upon impact. In this regard, using a pad of the present invention, the incoming ladle stream is reversed by the pad and travels vertically upwardly and then radially outwardly near the top of the bath. This pushes slag or other impurities away from the incoming ladle stream. For this reason and for the reason that the resulting flow is much slower than the flow created with past impact pads, less slag or other impurities and inclusions are entrained within the bath. A tundish pad of the present invention is especially advantageous during start-up, while changing grades of steel within the tundish, or when casting at low tundish levels.

It will therefore be appreciated that numerous advantages are presented by the tundish impact pad of the present invention. These advantages include the following:

1. The incoming ladle stream is contained and dampened to cause a slower flow of molten metal in the tundish for effectively allowing inclusions to float to the top surface of the molten metal bath.

2. The resulting flow patterns push slag and other impurities away from the incoming ladle stream thus preventing entrainment of these undesirable materials within the bath.

3. Surface directed flow of the molten metal is promoted and therefore inclusions or impurities must rise only a short distance before contacting the slag layer and becoming absorbed therein.

4. Erosion of the working lining on the side and end walls of the tundish is reduced as the incoming flow will not directly impact on these walls.

5. The amount of time that the molten metal remains in the tundish is increased since the path to the exit or exits of the tundish will be longer and more tortuous than with past impact pads.

6. As high velocity flows in the tundish will be minimized, the possibility of vortexing, which causes slag and inclusions to be drawn from the surface of the tundish down into the mold, will be reduced.

7. A much quieter metal surface is produced with less movement of the slag layer during steady state operation.

8. The unique flow pattern created by the pad promotes temperature homogeneity within the bath by creating full, slow circulation of molten metal throughout the tundish.

9. Splashing during start-up is significantly reduced.

10. The residence time for the metal within the bath is increased or, in other words, the time it takes for incoming metal to exit the bath into the mold or molds is increased. Impurities which, given sufficient time, will naturally float slowly to the top of the bath, are less likely to be included in the exiting stream as residence time is increased.

Further advantages of the present invention will become more readily apparent to those of ordinary skill upon review of the following detailed description of the preferred embodiment taken in conjunction with the accompanying drawings.

DETAILED DESCRIPTION OF THE PREFERRED EMBODIMENTS

Figure 1:
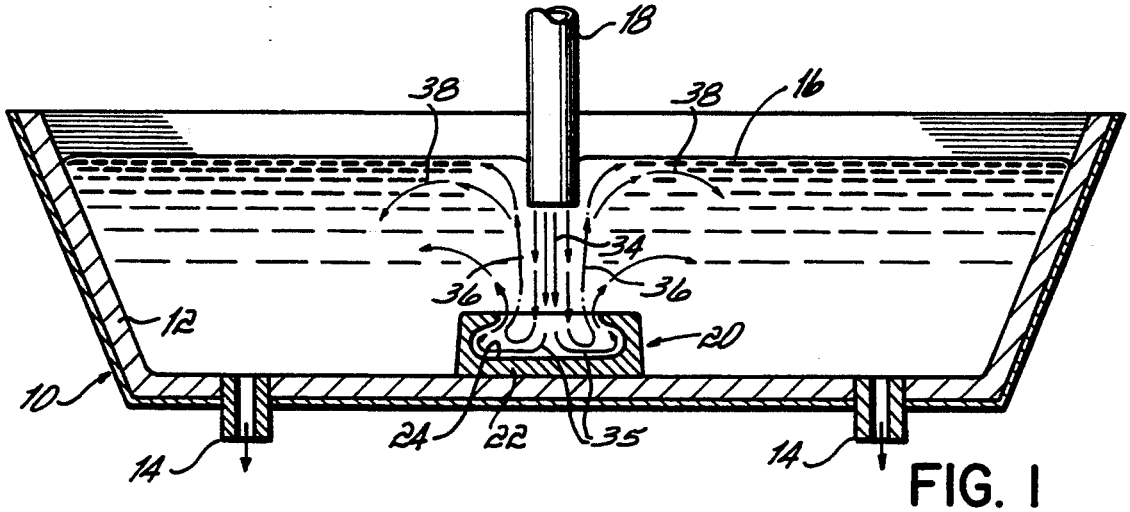
FIG. 1 is a side cross-sectional view of a tundish including the turbulence inhibiting impact pad of the present invention disposed on the bottom surface thereof.

Referring first to FIG. 1, a conventional tundish 10 is shown and includes an inner lining 12 and a pair of well blocks or outlets 14 for allowing molten metal from a bath 16 contained in the tundish 10 to continuously exit the tundish 10 and enter molds (not shown) which form metal castings. As is also conventional, a ladle shroud 18 is positioned above the tundish 10 and continuously directs a stream of molten metal into the tundish 10. A tundish impact pad 20 constructed according to the present invention is placed centrally on the floor of the tundish 10.

Figure 2:
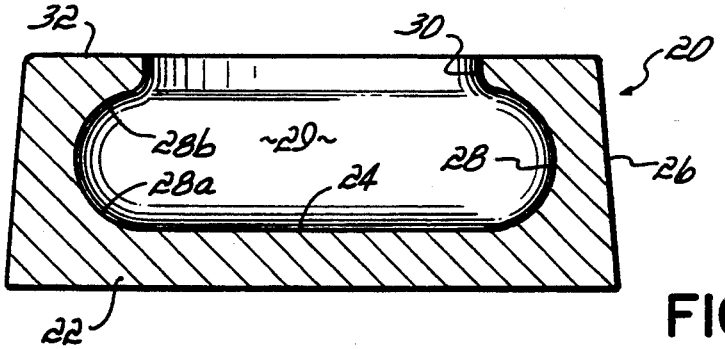
FIG. 2 is an enlarged cross-sectional view of the impact pad of FIG. 1.
Figure 3:
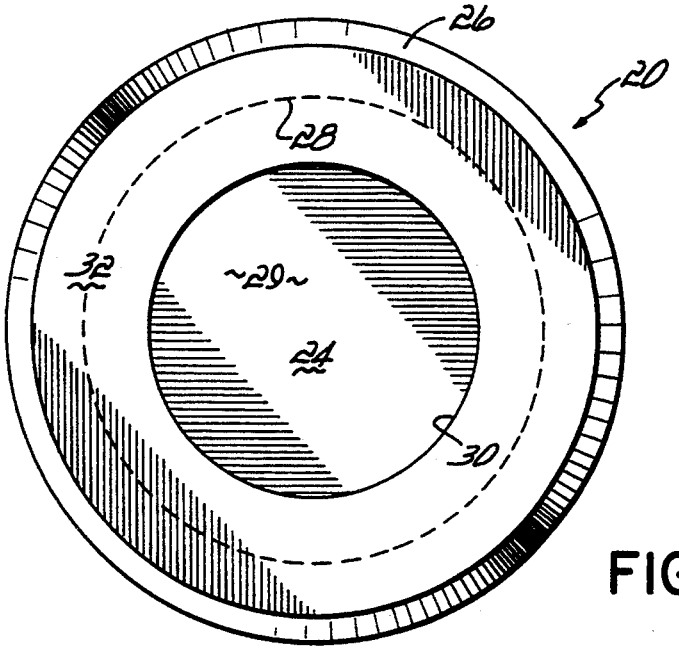
FIG. 3 is an enlarged top view of the impact pad of the present invention.

As best illustrated in FIGS. 2 and 3, the tundish impact pad 20 is preferably circular in shape and includes a base 22 having a planar impact surface 24. The pad 20 further includes an endless, preferably circular outer side wall 26 having a correspondingly circular shaped inner wall surface 28. The annular inner wall surface is concavely shaped as shown in FIG. 2 and extends upwardly from the planar impact surface 24 to fully enclose a curved interior space or cavity 29. One annular portion 28*a* of the inner side wall surface 28 curves concavely outwardly and upwardly from the impact surface 24 and meets another annular portion 28*b* which curves concavely inwardly and upwardly to a vertical inner wall surface 30. The concave shape of the inner side wall surface 28 helps to reduce erosion of the pad 20. However, rather than forming one continuous curve as shown in FIG. 2, surface portions 28*a* and 28*b* may alternatively be separated by a flat surface portion. Also, one or both of the annular surface portions 28*a* and 28*b* may also be flat and angled outwardly and inwardly, respectively, instead of curved. Satisfactory operation of the pad 20 may also be obtained even when portion 28*a* is eliminated, i.e., such that portion 28*b* extends upwardly and inwardly from surface 24. Each of these alternative designs still includes an annular side wall inner surface portion extending inwardly and upwardly toward the opening 30 to create the desired flow pattern described herein. Vertical surface 30 defines a circular opening in the impact pad 20 for receiving the stream of molten metal from the ladle shroud 18 and for allowing the metal to exit the cavity 29 in an upward direction. The tundish impact pad 20 further includes a planar peripheral top surface 32 which surrounds the opening created by the vertically oriented circular surface 30.

Figure 4:
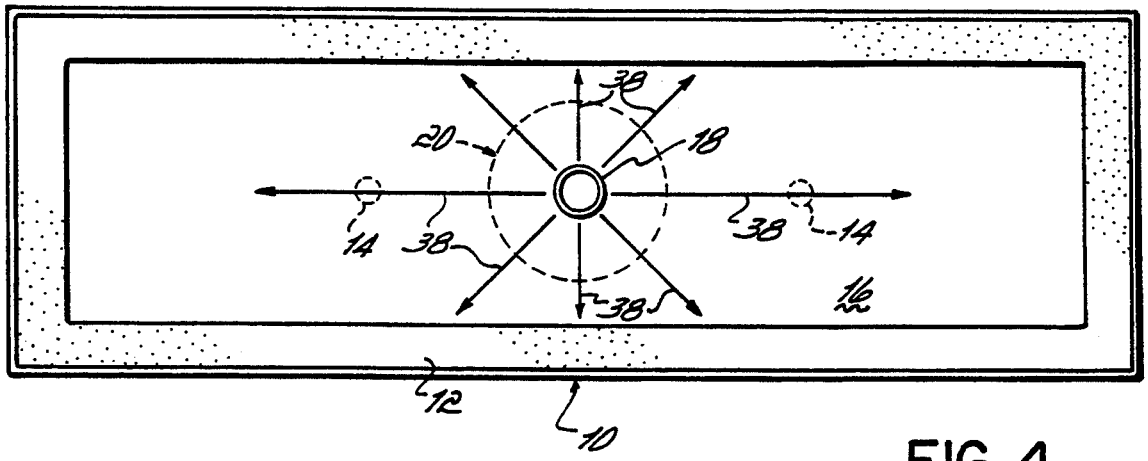
FIG. 4 is a top view of the tundish of FIG. 1 showing the radial outward flow pattern created proximate the top of the molten metal bath in the tundish by the impact pad of the present invention.

The effect of using the tundish pad 20 of the present invention is schematically shown in FIGS. 1 and 4. As shown in FIG. 1, a downward vertical stream of molten metal represented by arrows 34 is directed out of the ladle shroud 18 and onto a central location of impact surface 24 of the base 22. The stream of molten metal disperses radially outwardly within cavity 29 from the center of the impact surface 24 as shown by arrows 35 and follows the continuous inner side wall surface 28 in an upward direction. The stream exits the pad 20 and travels generally vertically upwardly as shown by arrows 36. The vertical upward movement of the stream caused by the tundish pad 20 significantly slows down the stream of molten metal as the two opposed vertical streams 34, 36 have a partially cancelling effect on one another.

The slowed upward stream 36 of molten metal continues toward the upper surface of the bath 16 contained in the tundish 10 and disperses generally radially outwardly, as indicated by arrows 38 in FIGS. 1 and 4, proximate the top surface of the bath 16. The radially outwardly directed flow streams 38, best shown in FIG. 4, cause slag and other impurities at the top surface of the bath 16 to be moved outwardly away from the ladle shroud 18 and away from the incoming stream 34 such that slag and other impurities are much less likely to be directed downwardly into the bath 16 by the incoming stream 34 where they may become entrained therein and eventually directed out of the tundish 10 through outlet well blocks 14 thus contaminating the final castings.

Figure 5:
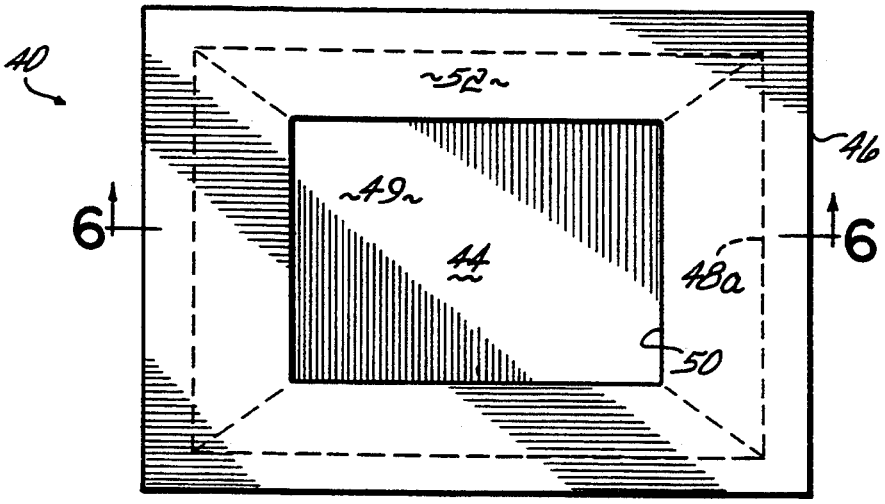
FIG. 5 is a top view of an alternative embodiment of the tundish impact pad of the invention; and, FIG. 6 is a side cross sectional view of the tundish impact pad of FIG. 5 taken along line 6—6.
Figure 6:
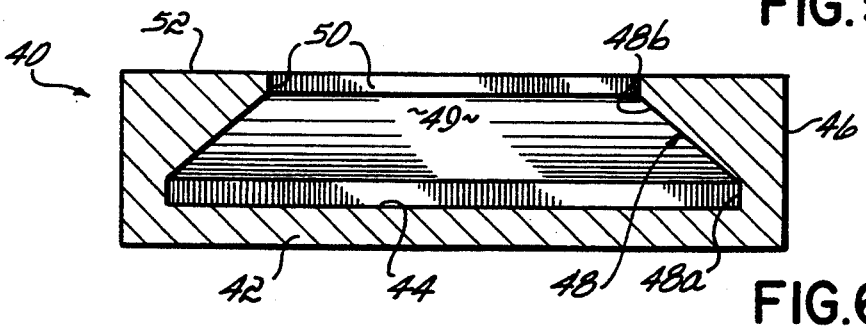

FIGS. 5 and 6 illustrate a second embodiment of the present invention and specifically show one alternative shape for the endless, annular side wall construction which creates a fully reversed flow of metal from the pad. More specifically, a tundish impact pad 40 is shown and includes a base 42 having a planar impact surface 44. The pad 40 further includes an endless annular, and in this case rectangular, outer side wall 46 having an annular, rectangular inner wall surface 48 extending upwardly and inwardly from the planar impact surface 44 and fully enclosing an interior space or cavity 49.

More particularly, a vertically oriented annular portion 48*a* of the inner side wall surface 48 extends upwardly from the impact surface 44 and meets another inwardly angled annular portion 48*b* which extends inwardly and upwardly to a vertical inner wall surface 50. The vertically oriented portion 48*a* is not absolutely necessary to satisfactory operation of the pad to create a flow pattern in accordance with the present invention. That is, the angled portion 48*b* may instead extend upwardly and inwardly directly from surface 44. Vertical surface 50 defines a rectangular opening in the impact pad 40 for receiving the stream of molten metal from the ladle shroud 18 and for allowing the metal to exit the cavity 49 in an upward direction. The tundish impact pad 40 further includes a planar peripheral top surface 52 which surrounds the opening created by the vertically oriented rectangular shaped wall surface 50. Impact pad 40 creates the same general flow pattern within a tundish as pad 20 of the first embodiment and as specifically shown by arrows 35, 36 and 38 in FIGS. 1 and 4.

It will thus be appreciated that the tundish impact pads 20, 40 of the present invention cause the incoming ladle stream to be completely reversed in an upward direction thus significantly slowing the stream and preventing undesirable high velocity flows and turbulence within the tundish 10. Furthermore, opposed radially outwardly directed currents are created on all sides of the ladle shroud 18 or incoming stream to push slag and other impurities away from the incoming stream thereby significantly lessening the likelihood of entraining impurities within the bath 16.

The resulting flow pattern further promotes surface directed flow of molten metal which therefore necessitates a shorter distance through which inclusions must rise before contacting the slag layer and becoming absorbed therein. The resulting flow pattern also reduces erosion of the working lining 12 on the side and end walls of the tundish 10. This is because the incoming flow 34 as well as the flow pattern which results from the tundish impact pads 20, 40 will not directly impact on either the side or end walls of the tundish 10.

It will also be appreciated that the flow pattern which results from the tundish pads 20, 40 increases the residence time of the molten metal within the tundish 10 as the path to the exit nozzle or well block 14 will be longer and more tortuous than with past impact pads. More specifically, instead of flowing directly along the bottom of the tundish 10 to the exit nozzles 14, the flow of molten metal within the tundish 10 is first directed vertically upwardly toward the surface of the bath 16 and then is slowly circulated downwardly toward the exit nozzles or well blocks 14. The slow velocities created by the tundish pads 20, 40 of the present invention further minimize the possibility of vortexing and surface turbulence in the bath 16. The opposed radially outwardly directed currents created by the tundish impact pads 20, 40 further promote temperature homogeneity within the bath 16 by creating continuous flow within substantially the entire bath 16. The impact pads 20, 40 also significantly reduce splashing during start-up and promotes greatly increased plug flow volume in the tundish 10 in the absence of other flow control devices such as dams, weirs and baffles.

The impact pads 20 and 40 are constructed from conventional refractory compositions which are resistant to the high temperatures of molten metals such as iron and steel. These temperatures may reach up to about 3000° F. As known in the art, suitable refractory materials may include MgO, $Cr_2O_3$, $Al_2O_3$, $ZrO_2$, CaO, and $SiO_2$, and mixtures of these materials, however, other refractory compositions may also be used as long as the chosen composition can withstand continuous contact with molten metals such as iron and steel. Two preferred compositions break down as follows:

| | 75% $Al_2O_3$ Composition | MgO Composition |
|---|---|---|
| $Al_2O_3$ | 75 | 3 |
| MgO | >1 | 89 |
| $SiO_2$ | 21 | 6 |
| CaO | 1 | 1 |
| $Fe_2O_3$ | 1 | >1 |
| Other Trace Amounts | 2 | 1 |

It will be appreciated that further modifications and substitutions to the present invention will become readily apparent to those of ordinary skill in the art without departing from the inventive concepts disclosed herein. For example, while the impact pad of the present invention is preferably circularly shaped and while one alternative shape has also been shown and described, it will be appreciated that many shapes for the side walls of the impact pad are possible and fall within the scope of the present invention. Any geometric shape which fully encloses or defines and endless boundary for an interior space of the pad and redirects the incoming molten metal flow back into itself and creates a flow pattern away from the ladle shroud will perform similarly to the illustrated embodiments. Other modifications will become apparent upon review of the foregoing application and applicant therefore intends to be bound only by the scope of the claims appended hereto.

What is claimed is:

1. A tundish impact pad formed from a refractory composition capable of withstanding continuous contact with molten metal, said pad comprising a base having an impact surface and an endless outer side wall extending upwardly therefrom and fully enclosing an interior space having an upper opening for receiving a stream of said molten metal, said outer wall including an annular inner surface having at least a first portion extending inwardly and upwardly toward said opening, whereby when a downwardly directed stream of molten metal from a ladle outlet disposed above said impact pad strikes said impact surface, said stream is directed outwardly toward said annular inner surface and then redirected upwardly and inwardly toward the incoming ladle stream.

2. The pad of claim 1 wherein said annular inner surface further includes a second portion extending outwardly and upwardly from said impact surface toward said first portion.

3. The pad of claim 2 wherein at least one of said first and second portions is a concave annular surface.

4. The pad of claim 3 wherein said first and second portions form a continuously curving annular concave surface.

5. The pad of claim 4 wherein said curved interior space is circular in shape.

6. The pad of claim 5 further comprising a vertically oriented annular surface extending upwardly from said first portion and defining said opening.

7. The pad of claim 1 wherein said interior space is circular in shape.

8. The pad of claim 1 wherein said interior space is rectangular in shape.

9. The pad of claim 1 further comprising a vertically oriented annular surface extending upwardly from said first portion and defining said opening.

10. The pad of claim 1 wherein said annular inner surface further includes a second portion extending upwardly from said impact surface to said first portion.

11. In a tundish vessel for holding a volume of molten metal and having a floor and sidewalls enclosing a region of impact and a drain, the improvement comprising an impact pad located in the region of impact and including a base having an impact surface and an endless outer side wall extending upwardly therefrom and fully enclosing an interior space having an upper opening for receiving a stream of said molten metal, said outer wall including an annular inner surface having at least a first portion extending inwardly and upwardly toward said opening, whereby when a downwardly directed stream of molten metal from a ladle outlet disposed above said impact pad strikes said impact surface, said stream is directed outwardly toward said annular inner surface and then redirected upwardly end inwardly toward the incoming ladle stream.

12. The pad of claim 11 wherein said annular inner surface further includes a second portion extending outwardly and upwardly from said impact surface toward said first portion.

13. The pad of claim 12 wherein at least one of said first and second portions is a concave annular surface.

14. The pad of claim 13 wherein said first and second portions form a continuously curving annular concave surface.

15. The pad of claim 14 wherein said curved interior space is circular in shape.

16. The pad of claim 15 further comprising a vertically oriented annular surface extending upwardly from said first portion and defining said opening.

17. The pad of claim 11 wherein said interior space is circular in shape.

18. The pad of claim 11 wherein said interior space is rectangular in shape.

19. The pad of claim 11 further comprising a vertically oriented annular surface extending upwardly from said first portion and defining said opening.

20. The pad of claim 11 wherein said annular inner surface further includes a second portion extending upwardly from said impact surface to said first portion.

21. A method of preventing turbulence and high velocity flow of molten metal in a tundish, the method comprising the steps of:

providing an impact pad within said tundish, said impact pad including an endless outer side wall extending upwardly therefrom and fully enclosing an interior spacing having an upper opening for receiving a stream of said molten metal, said outer wall including an annular inner surface having at least a first portion extending inwardly and upwardly toward said opening, directing an incoming stream of molten metal vertically downwardly into said tundish and against said impact pad from a ladle outlet disposed above an upper edge of said impact pad to create a bath of molten metal in said tundish, reversing said stream into a vertically upward and inward direction toward said incoming stream, and creating generally radially outward flows of said molten metal in said tundish on all sides of said incoming stream such that said flows are each directed away from said incoming stream toward the surface of said bath of molten metal.

* * * * *

UNITED STATES PATENT AND TRADEMARK OFFICE

CERTIFICATE OF CORRECTION

PATENT NO. : 5,358,551

DATED : October 25, 1994

INVENTOR(S) : Karl J. Saylor

It is certified that error appears in the above-indentified patent and that said Letters Patent is hereby corrected as shown below:

Column 8, Line 30, "end" should be -- and --.

Column 8, Line 62, "spacing" should be -- space --.

Signed and Sealed this

Seventh Day of March, 1995

Bruce Lehman

*Attest:*

BRUCE LEHMAN

*Attesting Officer*

*Commissioner of Patents and Trademarks*